United States Patent [19]

Lee

[11] Patent Number: 4,895,043

[45] Date of Patent: Jan. 23, 1990

[54] MEANS FOR LOCKING THE DIAL OF A TEMPERATURE CONTROLLER

[75] Inventor: In S. Lee, Suwon, Rep. of Korea

[73] Assignee: Samsung Electronics Co., Ltd., Suwon, Rep. of Korea

[21] Appl. No.: 270,044

[22] Filed: Nov. 14, 1988

[30] Foreign Application Priority Data

Nov. 19, 1987 [KR] Rep. of Korea ..... 20060

[51] Int. Cl.[4] ..... G05G 5/06

[52] U.S. Cl. ..... 74/527; 74/553

[58] Field of Search ..... 74/553, 527; 200/318.2, 200/566; 403/322, 325; 292/347, 352; 16/121

[56] References Cited

U.S. PATENT DOCUMENTS 599,245 2/1898 Merrill ..... 74/527 X
1,889,175 11/1932 Evans ..... 200/566 X
2,407,696 9/1946 Webster ..... 74/527
2,438,045 3/1948 Gerhardt et al. ..... 74/527
3,100,404 8/1963 Boeddeker et al. ..... 200/566 X
4,431,881 2/1984 Sauer et al. ..... 200/318.2

*Primary Examiner*—Rodney M. Lindsey
*Attorney, Agent, or Firm*—Flynn, Thiel, Boutell & Tanis

[57] ABSTRACT

Means for locking the dial of a temperature controller according to the present invention comprises a push rod for locking the controller when pushed once and releasing the locking to return to the original position when pushed anew, said push rod being installed inside the controlling shaft of the controller, a locking pin for reciprocating upwardly and downwardly along the periphery of the controlling shaft by pushing of the push rod, and a locking bracket for catching the upper end of the locking pin to prevent the rotation of the controlling shaft when the locking pin reaches the upward position.

3 Claims, 2 Drawing Sheets

MEANS FOR LOCKING THE DIAL OF A TEMPERATURE CONTROLLER

BACKGROUND OF THE INVENTION

The present invention concerns a temperature controller, and more particularly means for locking the dial of a temperature controller, whereby the shaft of the temperature controller cannot be arbitrarily rotated once the controller has been adjusted to a certain value.

For example, it is necessary to properly adjust the temperature inside a refrigerator according to the season of the kind of foods.

Conventionally, the temperature controller installed inside a refrigerator tends to be misadjusted by mishandling of others regardless of the user's intention, so that the stored foods can be deteriorated.

Therefore, it is preferable that such a temperature controller cannot be arbitrarily adjusted by others except the user.

However, the temperature controller of prior art has not the means for locking the controlling shaft of the controller to prevent such an arbitrary misadjustment, so that it must be often checked out or adjusted anew.

As a prior art, there is disclosed a control device having locking selector means in U.S. Pat. No. 3,999,442. This means can lock the controlling shaft only at the off position among all the positions of adjustment. Therefore, it cannot prevent misadjustment by others, too.

SUMMARY OF THE PRESENT INVENTION

It is an object of the present invention to provide means for locking a temperature controller at any adjusted position, so that the controller cannot be arbitrarily adjusted by others except the user.

In order to achieve such an object, means for locking the dial of temperature controller according to the present invention comprises a push rod for locking the controller when pushed once and releasing the locking to return to the original position when pushed anew, said push rod being installed inside the controlling shaft of the controller, a locking pin for reciprocating upwardly and downwardly along the periphery of the controlling shaft by pushing of the push rod, and a locking bracket for catching the upper end of the locking pin to prevent rotation of the controlling shaft when the locking pin reaches the upward position.

According to the means of the present invention, the user can lock the controlling shaft of the controller by pushing the push rod installed therein after the controller is adjusted to a proper value.

Hence, even if the controller is mishandled during operation of the others regardless of the user's intention, it keeps the originally adjusted position because the controlling shaft is not rotated as far as its locking is not released.

In order to reset the controller, the push rod already pushed is pushed anew so as to return to the original position for releasing the locking. Then, the resetting may be performed.

The present invention will now be described with reference to the drawings attached only by way of example.

BRIEF DESCRIPTION OF THE DRAWINGS

FIGS. 2A and 2B are cross-sections of the means of the present invention, wherein:

FIG. 2A represents the position of releasing the dial locking;

FIG. 2B represents the position of the dial locking;

DETAILED DESCRIPTION OF A PREFERRED EMBODIMENT OF THE PRESENT INVENTION

Figure 1:
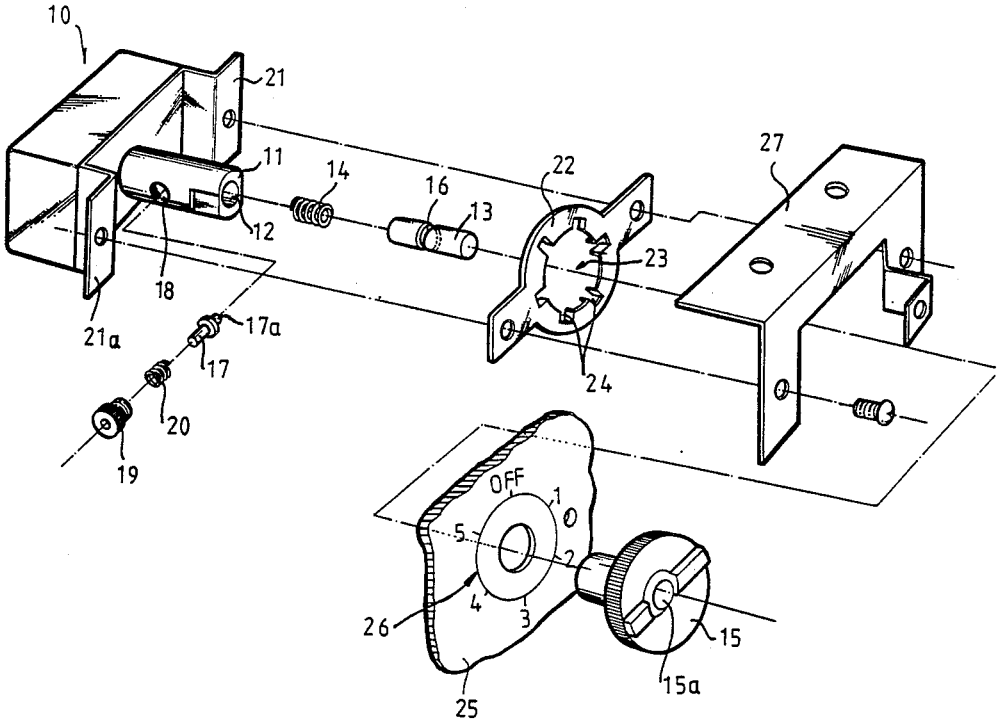
FIG. 1 is an exploded view of the means for locking the dial of a temperature controller according to the present invention.

In FIG. 1 is schematically depicted an embodiment of the temperature controller of the present invention, which is, for example, used for a refrigerator.

A push rod 13 with a spring 14 is inserted into the cylindrical opening 12 provided in the controlling shaft 11 of a temperature controller 10. Push rod 13 is resiliently supported by the spring, and the pushing end thereof is exposed through the central hole 15*a* of dial 15 associated with the end of controlling shaft 11.

Figure 3:
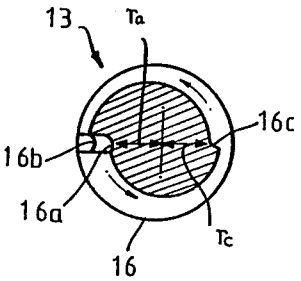
FIG. 3 is a cross-section for illustrating the essential part of the means of the present invention.

Push rod 13 has a spiral guide groove 16. Spiral guide groove 16 is extended through about one pitch, whose beginning end 16*a* and final end 16*b* are shaped to have a concave semisphere, and are connected with each other through guide groove is bill-shaped. The radius rc of the central portion 16*c* from the center of the controlling shaft is greater above center. (see FIG. 3).

From the side surface of controlling shaft 11 to cylindrical opening 12 is extended a tapped hole 18, with which a supporting tube 19 is engaged. Into supporting tube 19 is inserted locking pin 17 with spring 20. The inner end protrusion 17*a* of locking pin 17 is continuously engaged with the spiral guide groove 16 of push rod 13, and the outer end thereof may be projected outside the supporting tube 19.

Locking bracket 22 is fixed to the retaining portions 21*a* and 21*b* positioned at both sides of temperature controller 10. The locking bracket has a circular opening 23, and plurality of locking cuts 24 formed concavely at equi-distance along the periphery of the circular opening. Controlling shaft 11 is positioned through the circular opening, and may be rotated therein with locking pin 17 being not protruded.

A plurality of locking cuts 24 are formed to accurately correspond with the temperature indicating scale 26, which is marked on cover 25 to adjust dial 15.

The reference numeral 27 not explained represents the fixing bracket to connect the controller 10 and cover 25 with each other.

Figure 2B:
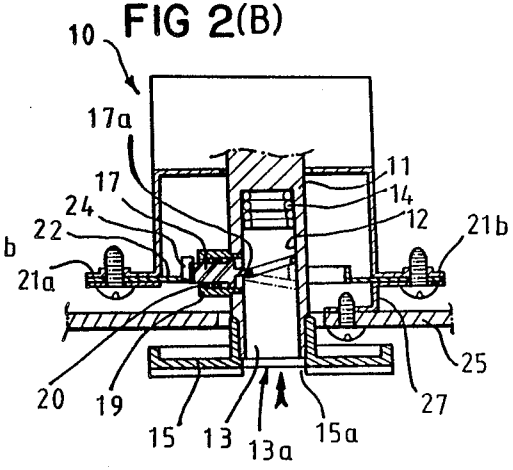
Figure 2A:
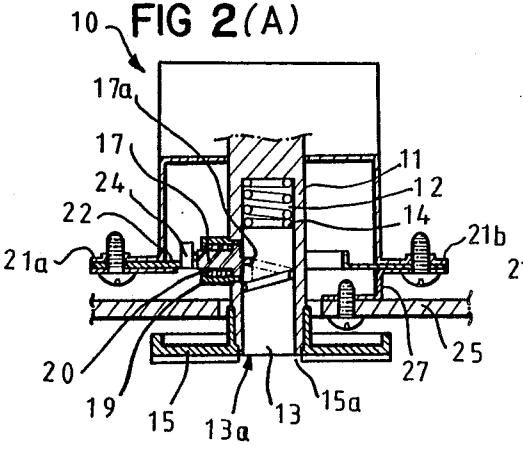
Figure 4:
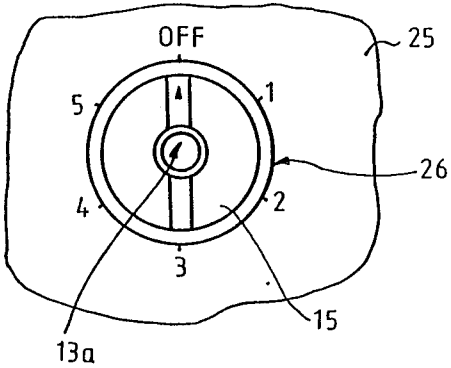
FIG. 4 is a front view of the dial of a temperature controller.

Referring to FIG. 2A, in the state of releasing the locking is not pushed push rod 13, so that the inner end protrusion 17*a* of locking pin 17 is placed in the beginning end 16*a* of spiral guide groove 16 provided in push rod 13. In this case, because the radius ra is smaller than the others, the outer end of locking pin 17 is not substantially protruded outside supporting tube 19.

As described above, locking pin 17 may be rotated in the circular opening 23 of locking bracket 22, and therefore, controlling shaft 11, too.

Hence, the user may set a desired temperature according to the temperature indicating scale 26 by rotating dial 15 associated with controlling shaft 11.

Referring to FIG. 2B, when pushing the pushing end 13*a* of push rod 13 exposed through the central hole 15*a* of the dial, push rod 13 rotates as well as advances with spring being compressed, because the proturusion 17*a* of locking pin 17 is engaged with spiral guide groove 16 of push rod 13.

As push rod 13 advances with rotating, the protrusion 17*a* of locking pin moves from the beginning end 16*a* of spiral guide groove 16 to the central porton 16*c* thereof. Once the protrusion 17*a* reaches the central portion 16*c*, pushing of the push rod is stopped. Then, the push rod is not retracted in spite of the resilient force of spring 14, because the central portion 16*c* is bill-shaped.

Consequently, the radius rc of central portion 16*c* is greater than the radius ra of the beginning end 16*a* and therefore, locking pin 17 is pushed outwardly through the radius difference (rc-ra), so that the outer end thereof is protruded, and the spring thereof is compressed.

Hence, the outer end of locking pin 17 is engaged with one of the plurality of locking cuts 24 of locking bracket 22, which is selected by the operation of dial 15, so that the controlling shaft 11 is not rotated, locked.

If it is desired to reset the temperature position of the controller, the push rod in the locking state of FIG. 2B is pushed again to release the locking.

Namely, the push rod is pushed until the protrusion 17*a* of locking pin 17 reaches the final end 16*b* of spiral guide groove 16 from the central portion 16*c* thereof, and released. Then, because the final end 16*b* communicates with the beginning end 16*a* through the straight channel, the push rod is immediately retracted by the resilient force of spring 14. Subsequently, locking pin 17 is released to the original position by spring 20, so that the outer end thereof is retracted from locking cut 24 of locking bracket 22 to release the locking as shown in FIG. 2A, thereby making possible resetting of the temperature position.

Although the present embodiment describes the temperature controller used in a refrigerator, it will be readily appreciated that the present invention has applications in the field of general controllers, and that various modifications may be made without departing from the spirit of the present invention.

As described above, once a controller having the locking means of the present invention is adjusted to a desired value and locked by the user, even mishandling of it cannot affect the normal operation.

What is claimed is:

1. Means for locking the dial of a temperature controller comprising a controlling shaft having a cylindrical opening, a push rod for locking said controller when pushed once and releasing the locking to return to the original position when pushed again, said push rod having a spiral guide groove and being placed in said cylindrical opening, a spring for resiliently supporting said push rod, a locking pin for reciprocating upwardly and downwardly along the periphery of said controlling shaft according to the pushing of said push rod, a supporting tube for supporting said locking pin, another spring for resiliently supporting said locking pin, and a locking bracket for preventing the rotation of said controlling shaft, said locking bracket having a circular opening and a plurality of locking cuts formed concavely along the periphery of the circular opening, said controlling shaft being rotated in said circular opening with said locking pin being not protruded, whereby the rotation of said controlling shaft is prevented by said locking pin engaging with one of said locking cuts when said locking pin is protruding.

2. Means for locking the dial of a temperature controller as claimed in claim 1, wherein said spiral guide groove is extended through about one pitch, the beginning end and final end of said spiral groove being connected with each other through a straight channel, the radius of the central portion of said spiral groove from the center of said controlling shaft being greater than the radius of the beginning end from said center.

3. Means for locking the dial of a temperature controller as claimed in claim 1, wherein said locking pin resiliently supported by said spring in said supporting tube has an inner end protrusion, said protrusion being continuously engaged with said spiral groove of said push rod.

* * * * *